United States Patent [19]

Whitten, II

[11] 4,251,097

[45] Feb. 17, 1981

[54] DISPOSIBLE SCOOP AND CONTAINER FOR CLEANING UP OFFENSIVE MATERIAL

[76] Inventor: William B. Whitten, II, 28 Norwood St., Albany, N.Y. 12203

[21] Appl. No.: 12,600

[22] Filed: Feb. 16, 1979

[51] Int. Cl.[3] ..... A47L 13/52

[52] U.S. Cl. ..... 294/1 B

[58] Field of Search ..... 294/1 B, 55; 15/104.8, 15/257.1; 229/38, 410, 19, 37 R

[56] References Cited

U.S. PATENT DOCUMENTS

| | | | |
|---|---|---|---|
| 3,286,826 | 11/1966 | Stoll | 294/1 B |
| 3,765,044 | 10/1973 | Hanahan et al. | 15/104.8 |
| 3,885,266 | 5/1975 | Nafziger | 294/1 B |
| 3,917,333 | 11/1975 | Grattan | 294/1 B |
| 3,971,503 | 7/1976 | Allan | 294/1 B |
| 3,995,807 | 12/1976 | Dell'Anno | 294/1 B |
| 4,154,389 | 5/1979 | Dell'Anno | 294/1 B |
| 4,155,581 | 5/1979 | Kanaga | 294/1 B |

*Primary Examiner*—James B. Marbert

*Attorney, Agent, or Firm*—Heslin, Irwin & Nieman

[57] ABSTRACT

A scoop made of a single paperboard blank. A back wall, with a transverse slot, is folded upward. Two side portions, with rear tabs, are folded upward and the rear tabs are folded inward behind the back wall. The top of the back wall is folded down causing the corners of the rear tabs to extend through the slot. Thus, the scoop is locked into its assembled position. A flexible container may be provided as a receptacle for the offensive materials and the soiled scoop.

6 Claims, 2 Drawing Figures

DISPOSIBLE SCOOP AND CONTAINER FOR CLEANING UP OFFENSIVE MATERIAL

BACKGROUND OF THE INVENTION

The invention relates to paperboard scoops, and paperboard scoops in combination with flexible containers.

Due to the enactment of various local laws and ordinances in several cities around the country, it has become necessary for pet owners to clean up their pets' feces off of the public sidewalks and streets. Devices are presently available for such a purpose, however, they suffer from various disadvantages. Some of these prior devices are relatively expensive to produce and therefore are not totally disposable after a single use. Others are relatively bulky and therefore cannot be conveniently carried on one's person. Still other devices leave offensive material exposed on their surfaces after the clean-up operation is performed. Some prior devices suffer the disadvantage of not being able to make repeated scoops, if not all of the litter is picked up on the first try, and some devices suffer from more than one of the above disadvantages.

It would be advantageous to provide an apparatus, for cleaning up such offensive waste materials, which apparatus could be carried on one's person in a flattened condition and which could be easily assembled for use. It would also be advantageous to provide apparatus which would prevent contact between the offensive material and the person cleaning up such material during and after use, and which could be easily and inexpensively disposed of.

SHORT STATEMENT OF THE INVENTION

An object of the invention is to provide a scoop and a container which one may totally and inexpensively dispose of after use.

Another object of the invention is to provide a scoop and a container which remain in a flattened condition, for storage and carrying, until ready for use.

A further object of the invention is to provide a scoop which may be easily assembled into a sturdy construction from a flat paperboard blank.

A still further object of the invention is to provide a scoop which is inexpensive to manufacture.

Another object of the invention is to provide a scoop and container, such that the scoop, after contacting the offensive waste material, can be sealed in the container and thus, there is no offensive waste material exposed which might contact the operator of the invention.

These and other objects are more fully described below.

The invention includes a scoop made of a single paperboard blank. The scoop remains in a flattened condition until it is needed for use. To assemble the scoop, a back wall having a transverse slot is folded upward. Next, two side portions with rear tabs are folded upward and the rear tabs are folded inward behind the back wall. Then, the top part of the back wall is folded down thereby causing the corners of the rear tabs to extend through the slot in the back wall. This locks the tabs into place and the scoop into a fully assembled position.

A flexible container may be provided for accepting animal feces or other waste material, and for accepting the soiled scoop. The flexible container is then sealed, after which the operator can dispose of it and its contents at his convenience.

DETAILED DESCRIPTION OF THE INVENTION

Figure 1:
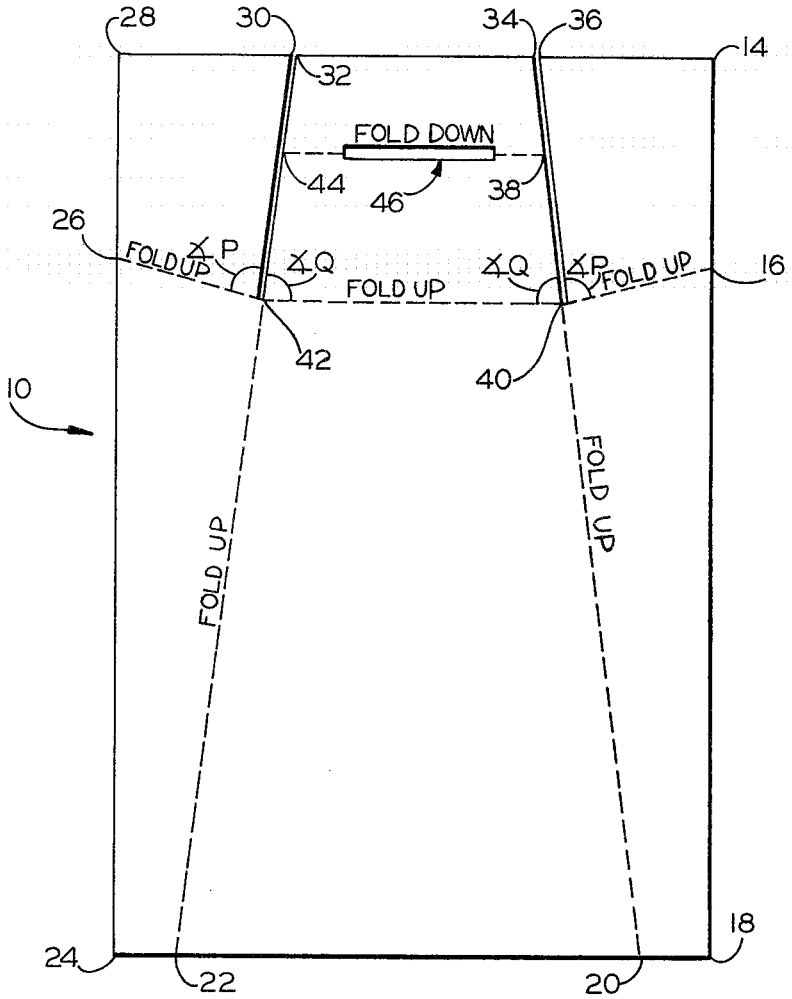
FIG. 1 is a plan view of the blank from which the invention is made.
Figure 2:
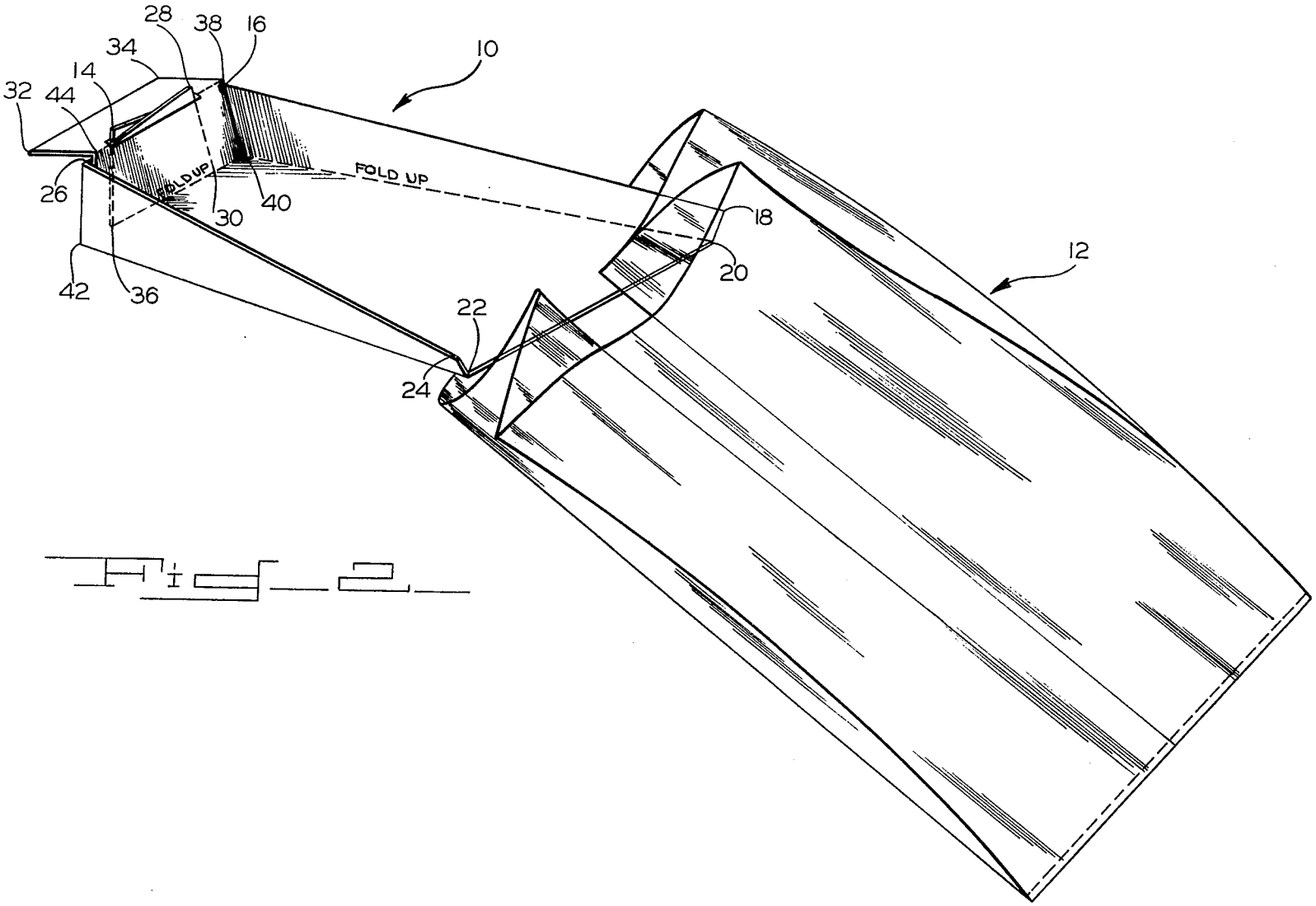
FIG. 2 is a perspective view of the fully assembled invention.

Referring to FIGS. 1 and 2, a paperboard scoop is designated generally by number 10 and a flexible container by number 12. In the preferred embodiment, the paperboard scoop is made out of a construction paper type of cardboard, however, any type of cardboard, pasteboard, plastic or fiberboard may be used. Accordingly, throughout this disclosure, the term "paperboard" is intended to include any flat, flexible material whose properties would render such material suitable for use in the invention.

Flexible container 12 is preferably a plastic bag (hence it is seen as translucent in FIG. 2), or a treated paper bag, such as wax paper (not shown), however, other types of containers may be used.

Referring again to FIGS. 1 and 2, paperboard scoop 10 is labeled with a plurality of points 14 through 44. The paperboard blank is preferably of a rectangular shape, with corners defined by points 14, 18, 24 and 28.

A first transverse crease is formed along the line connecting points 40 and 42. This first transverse crease is preferably parallel to the front edge of the blank defined by the line connecting points 18 and 24. A second transverse crease is defined by the line connecting points 38 and 44. This second transverse crease is preferably parallel to the first, and has a slot 46 extending partially along it.

A pair of longitudinal creases are formed in the paperboard blank. One is defined by the line connecting the point 20 to the points 34 and 36, and the other is defined by the line connecting the point 22 to the points 30 and 32. The longitudinal creases are slit, one from point 40 to points 34 and 36, and the other from points 42 to points 30 and 32.

Finally, a pair of third transverse creases are formed in the blank. One of said creases is defined by the line connecting the point 16 to the point 40, and the other by the line connecting the point 26 to the point 42.

In the preferred embodiment, the angles P, between each longitudinal crease and each third transverse crease, are approximately equal to the angles Q, between each longitudinal crease and the first transverse crease. Both angles P and Q are preferably just slightly less than 90°, optimally between 81° and 87°.

Thus, three regions, or portions, of the paperboard blank are defined. There is one central portion and there are two side portions. The central portion is defined by the interior of points 20, 22, 32 and 34. The two side portions are defined by the interior of points 14, 18, 20 and 36; and the interior of points 22, 24, 28 and 30, respectively. Thus, it can be seen that the longitudinal creases are the boundaries between the central portion and each side portion.

The central portion is further broken down into a bottom wall, defined by the points 20, 22, 42 and 40, and a back wall defined by the points 32, 34, 40 and 42. Thus, the bottom wall is separated from the back wall by the first transverse crease.

Each side portion is further divided into a side wall and a rear tab. The side walls are defined by the points 16, 18, 20 and 40; and the points 22, 24, 26 and 42, respectively. The rear tabs are defined by the points 14, 16, 40 and 36; and the points 26, 28, 30 and 42, respectively. Thus, each side wall is separated from its adjacent rear tab by the respective third transverse creases.

It is believed that each paperboard blank can be appropriately cut and creased by use of conventional machinery used for stamping such blanks.

To assemble scoop 10, the back wall is folded up along first transverse crease 40–42. Next, each side portion is folded up along its longitudinal crease 20–34,36 and 22–30,32, respectively. After the side portions have been folded up, each rear tab is successively folded inward along its third transverse crease, 16–40 and 26–42, respectively, so that each tab will be positioned behind the back wall. Finally, the top of the back wall is folded down along the second transverse crease 38–44 so that the corner of each rear tab (points 14 and 28, respectively) will project through the slot in the back wall. (See, FIG. 2.) With the completion of this step, the rear tabs are locked into place and the scoop is fully assembled. Thus, tab and slot means (comprising slot 46 and the rear tabs) for locking the side walls and the back wall into erected positions is provided.

In operation, scoop 10 is assembled and used to pick up animal feces or other refuse material. The erected side and back walls support the bottom wall and prevent it from flexing when it is loaded. Such refuse is then dumped from the scoop into flexible container 12. After all the refuse has been picked up, scoop 10, which is now soiled, may be disassembled into a flattened shape and placed into flexible container 12. (It is not essential to disassemble the scoop before placing it into the container.) Then, the flexible container may be closed by means of a wire twister or other fastener thereby sealing both the soiled scoop and the refuse within the container.

Thus, it is seen that a relatively strong inexpensive scoop may be manufactured out of a single rectangular paperboard blank, thereby leaving no waste materials after the blank is cut. No assembly is necessary prior to selling the scoop, as it may be easily assembled by the user without staples, adhesives or other fasteners.

It will be obvious to those with ordinary skill in the art that variations and modifications of the above disclosed preferred embodiment of the invention can be made. For example, the second transverse crease can be totally eliminated, so long as the slot remains. Another variation would be to provide tab and slot means for locking the side walls and back wall into erected positions, by providing tabs which are hingedly connected to the back wall and adapted to be engaged into slots in each side wall. Other variations are possible and it is intended that all such variations and modifications be included within the spirit and scope of the invention as claimed below.

What is claimed is:

1. A scoop, made of a single paperboard blank, comprising:

a central portion, which has a bottom wall and a back wall, with a first transverse crease separating the bottom wall from the back wall, said back wall having a top portion and a second transverse crease for allowing the top portion to be folded downward, and said back wall having a slot extending partially along the second transverse crease;

a side portion, separated from the central portion by a longitudinal crease, said side portion having a side wall and a rear tab, said rear tab having a top corner, with a third transverse crease separating the side wall from the rear tab, and said longitudinal crease being slit along the edge of the rear tab;

such that when the back wall is folded up along the first transverse crease, the side portion is folded up along the longitudinal crease, the rear tab is folded inward along the third transverse crease, and the back wall is folded downward along the second transverse crease, then the top corner of the rear tab will partially project through the slot in the back wall thereby locking the scoop into an assembled position.

2. The scoop of claim 1 further comprising:

a second side portion, similar in structure to the first side portion, attached to the central portion opposite the first side portion.

3. The scoop of claim 2 wherein the paperboard blank is of a rectangular cofiguration, wherein the longitudinal creases converge toward the rear end of the blank, wherein the first and second transverse creases are parallel to the front end of the cardboard blank, and wherein the acute angle formed between each longitudinal crease and each third transverse crease is approximately equal to the acute angle between each longitudinal crease and the first transverse crease, both of these angles being less then 90°.

4. The invention of claim 3 wherein the first transverse crease intersects the third transverse crease of each side portion at the same point where the longitudinal crease of each side portion intersects its associated third transverse crease.

5. The invention of claim 4 wherein each acute angle is between 81° and 87°.

6. The scoop of claims 1, 2, 3, 4 or 5 in combination with a flexible container, such that the scoop may be used to pick up refuse and to deposit the refuse in the container, and then the soiled paperboard scoop may be deposited in the container and everything may be disposed of in a sanitary manner.

* * * * *